US006125484A

United States Patent [19]

Thomson

[11] Patent Number: 6,125,484

[45] Date of Patent: Oct. 3, 2000

[54] MODULAR BED FRAME

[76] Inventor: Charles Thomson, 1248 Larch Ave., Moraga, Calif. 94556

[21] Appl. No.: 09/334,434

[22] Filed: Jun. 16, 1999

[51] Int. Cl.[7] ..... A47C 19/04

[52] U.S. Cl. ..... 5/200.1; 5/201; 5/202; 5/207

[58] Field of Search ..... 5/200.1, 201, 202, 5/207, 203, 204, 185

[56] References Cited

U.S. PATENT DOCUMENTS

| | | | |
|---|---|---|---|
| 1,358,027 | 11/1920 | Sheldon . | |
| 1,493,104 | 5/1924 | Carrigan . | |
| 2,567,619 | 9/1951 | Rosenfeld | 5/181 |
| 2,644,959 | 7/1953 | Blanke et al. | 5/201 X |
| 2,644,960 | 7/1953 | Blanke et al. | 5/185 |
| 2,674,749 | 4/1954 | Longnecker | 5/181 |
| 2,745,117 | 5/1956 | Sands | 5/200.1 |
| 2,772,424 | 12/1956 | Roche et al. | 5/176 |
| 2,968,051 | 1/1961 | Imber et al. | 5/181 |
| 3,003,158 | 10/1961 | Sevcik | 5/181 |
| 3,123,837 | 3/1964 | Paine et al. | 5/181 |
| 3,230,555 | 1/1966 | Hooker | 5/285 |
| 3,646,623 | 3/1972 | Harris, et al. | 5/181 |
| 3,757,361 | 9/1973 | Harris et al. | 5/184 |
| 3,760,437 | 9/1973 | Hooker | 5/201 |
| 3,761,970 | 10/1973 | Fredman | 5/181 |
| 3,761,971 | 10/1973 | Behnke | 5/201 |
| 3,824,638 | 7/1974 | Bogar, Jr. | 5/181 |
| 3,871,039 | 3/1975 | Garceau et al. | 5/181 |
| 3,961,384 | 6/1976 | Spitz | 5/184 |
| 4,007,502 | 2/1977 | Mis | 5/202 |
| 4,027,343 | 6/1977 | Hooker | 5/200 |
| 4,106,141 | 8/1978 | Hooker | 5/201 |
| 4,135,266 | 1/1979 | Knoke | 5/201 |
| 4,192,028 | 3/1980 | Knoke | 5/181 |
| 4,224,704 | 9/1980 | Nowell | 5/200.1 X |
| 4,295,234 | 10/1981 | Whitehead | 5/184 |
| 4,458,371 | 7/1984 | Whitehead | 5/200.1 |
| 4,554,692 | 11/1985 | Whitehead | 5/207 X |

*Primary Examiner*—Michael F. Trettel
*Attorney, Agent, or Firm*—D'Alessandro & Ritchie

[57] ABSTRACT

A modular bed frame is disclosed which includes one or more pairs of complimentary side-rails, with attached cross-bars, that may be linked in a manner so as to support a plurality of box-spring and mattress sizes. The advantages of the present invention include an inventory reduction of different components than currently necessary, and elimination of a majority of separate fasteners. The bed frame incorporates an inverted L-shaped cross-section which permits a box-spring to be supported on a pair of bed frames attached side-by-side. Along the side-rails are disposed a set of flanges which are rotatable so as to enable side-by-side bed frames to be slidably attached to each other in one orientation, or inhibiting lateral movement of a box-spring in another orientation. Optionally, a sleeve demountably attaches a pair of cross-bars by a slidable pin, the cross-bars having multiple openings permitting the pin to secure the cross-bar pair so as to accommodate several different box-spring sizes in commercially available widths.

23 Claims, 5 Drawing Sheets

MODULAR BED FRAME

FIELD OF THE INVENTION

The present invention relates to a novel bed frame.

BACKGROUND OF THE INVENTION

Adjustable bed frames to accommodate a plurality of spring-board and mattress widths are well known in the art. Typically, these bed frames consist of a pair of left and right side-rails disposed parallel to one another at a specified distance, a right pair of cross-bars joined to a right side-rail and a left pair of cross-bars joined to a left side-rail, and legs to support the assembled bed frame. The conventional construction of such a bed frame is from metal beam using an L-shaped cross-section wherein the vertical portion of the L-shaped cross-section projects upwardly to inhibit sideward misalignment of the box-spring, and the horizontal portion supports the weight of the box-spring and mattress. The use of metal beam has the benefit of providing adequate structural rigidity combined with moderate weight and cost.

The cross-bars are typically connected at one end to the side-rails at some specified distance from the head and the foot of the bed frame. Some designs incorporate a demountably slidable attachment for securing a cross-bar from one side-rail to a cross-bar from another side-rail along a length in which the cross-bars overlap. Such designs complicate warehouse inventory by necessitating sleeves and inserts that add weight, or increase the number of small parts needed for assembly. Other designs attach the cross-bar to the side-rail by means of a pin joint allowing the cross-bar to be rotatable with preferred pivot positions of approximately parallel to its connected side-rail for disassembled storage, and approximately perpendicular to its connected side-rail for assembled bed frame use. Commonly, the metal beam orientation of the cross-bar is opposite to the side-rail, with the cross-bar pin-mounted below the side-rail to enable free rotation of the cross-bar around the pivot pin joint. However, no automatic restriction to the rotation is provided in this configuration, so that the cross-bar may rotate a full 360° around the pin joint, even though only a 90° travel is typically required to achieve the preferred pivot positions.

The cross-bars from opposing left and right side-rails are generally connected to each other in such a manner that the right and left cross-bars at the head are demountably attached to each other, with a similar arrangement at the foot. Typically, the corresponding cross-bars are demountably attached by a slidable sleeve which is held in place by a removable friction element.

Cross-bars are typically designed to permit several positions at which a joined pair of cross-bars may be secured. Such a design feature enables a bed frame to be assembled so as to accommodate a number of established box-spring widths available on the market. The current market has available sizes such as single, twin, full, queen, cal-king and king. However, a bed frame which is wider than full-size may provide insufficient structural support to a box-spring and mattress in the absence of a reinforcement mechanism. Past solutions to provide additional support for queen- and king-size bed frames have incorporated a center-rail between the left and right side-rails with means to connect the center-rail to the cross-bars. However, even with this center-rail support, the mattress and bed-spring may be allowed to deflect significantly for a wide bed under the load of reclining persons. In addition, this mechanism for addressing adequate bed frame rigidity for wider beds increases the number of different parts on inventory that must be warehoused to satisfy consumer demand. Since warehouse space represents an additional cost in business, a reduction of redundant components would be desirable.

Furthermore, queen- and king-size box-springs and mattresses are generally longer than their twin- and full-size counterparts, and cal-king-size counterparts are longer still. Consequently, the addition of a center-rail to a shorter adjustable bed frame to accommodate a wider and longer box-spring and mattress leaves a cantilever of several inches. Consequently, when someone sits down on the unsupported end of a queen-size mattress lying on a width-expanded short bed frame, the load applied by the sitting person may produce a moment causing the box-spring to pivot on the end of the bed frame—upward at the head and downward at the foot, potentially causing the person sitting to unexpectedly fall off the bed.

Modern adjustable bed frames typically incorporate bed-legs for supporting the rails and cross-bars some distance above the floor. To facilitate locomotion of the assembled bed frame within a room, the legs often include wheels or castors at their bottom end. Other designs use a pad at the bed-leg bottom end to distribute the bed's weight across a wider area. In order to reduce the risk of a barefoot person approaching an assembled bed frame arranged for slumber from carelessly stubbing a toe on a bed-leg, the legs are attached inward from the side-rails. In the past, this feature has been satisfied by attaching the legs to the cross-bar. Aside from a restriction in mounting location flexibility, an additional risk is engendered from a lateral force applied to the bed-leg (such as from a person stubbing a toe) producing a moment from the pivot attachment between the cross-bar and the rail to thus loosen or even disconnect the cross-bar attached to the bed-leg from the opposite-side cross-bar.

The current adjustable bed frame designs require inventory of multiple types of parts to satisfy the existing variety of bed frame sizes, as well as impose other limitations, such as consumer safety and convenience. Hence, it would be desirable to overcome these restrictions to reduce inventory space requirements and increase flexibility in implementation.

SUMMARY OF THE INVENTION

A modular bed frame is disclosed which includes one or more pairs of complimentary side-rails, with attached cross-bars, that may be linked in a manner so as to support a plurality of box-spring and mattress sizes. The advantages of the present invention include an inventory reduction of different components than currently necessary, and elimination of a majority of separate fasteners. The bed frame incorporates an inverted L-shaped cross-section which permits a box-spring to be supported on a pair of bed frames attached side-by-side. Along the side-rails are disposed a set of flanges which are rotatable so as to enable side-by-side bed frames to be slidably attached to each other in one orientation, or inhibiting lateral movement of a box-spring in another orientation. Optionally, a sleeve demountably attaches a pair of cross-bars by a slidable pin, the cross-bars having multiple openings permitting the pin to secure the cross-bar pair so as to accommodate several different box-spring sizes in commercially available widths.

DETAILED DESCRIPTION OF THE PREFERRED EMBODIMENTS

Those of ordinary skill in the art will realize that the following description of the present invention is illustrative only and not in any way limiting. Other embodiments of the invention will readily suggest themselves to such skilled persons after a perusal of the within disclosure.

The present invention is a modular bed frame designed so that select narrow sizes may be accommodated by a single pair of side-rails with cross-bars, and select wide sizes may be accommodated by two pairs of side-rails with cross-bars attached in tandem side-by-side.

The present invention is a modular bed frame having one or more pairs of complimentary side-rails with attached cross-bars, which may be linked in a manner so as to support a plurality of box-spring and mattress sizes. The advantages of the present invention include an inventory reduction of different components than currently necessary, and elimination of a majority of separate fasteners.

Instead of a conventional L-shaped cross-section for the construction (with the horizontal member disposed at the bottom of the vertical member), the present invention incorporates an inverted L-shaped or Γ-shaped (gamma) cross-section (with the horizontal member disposed at the top of the vertical member), permitting the box-spring to be disposed flat on a horizontal plane formed by the horizontal surfaces of two bed frame cross-sections disposed side-by-side without any vertical member acting as a fulcrum to produce a see-saw imbalance. The box-spring is inhibited from sliding from side-to-side off the bed frame by a plurality of tangs which may be positioned vertically up above the horizontal plane of the side-rail horizontal surface for the end side-rails, or alternatively positioned horizontally at or below the horizontal plane of the side-rail horizontal surface for the center side-rails. The tangs are integrally connected to flanges, which may pivot to accommodate either of these tang positions.

The cross-bars' connections in the present invention enable a plurality of positions from which to select a bed frame width in order to accommodate the sundry box-spring and mattress sizes available on the market. The bed-legs are attached to the side-rails rather than to the cross-bars in order to better facilitate these sizes. Each cross-bar is connected to a side-rail by a rivet or pin-joint, enabling rotation between positions approximately parallel to the side-rail for storage and transport or approximately perpendicular to the side-rail for bed frame assembly. In the present invention, the inverted L-shaped cross-section prevents the cross-bars from rotating more than 180°, whereas conventional rotatable cross-bars are generally not so restricted.

Figure 1A:
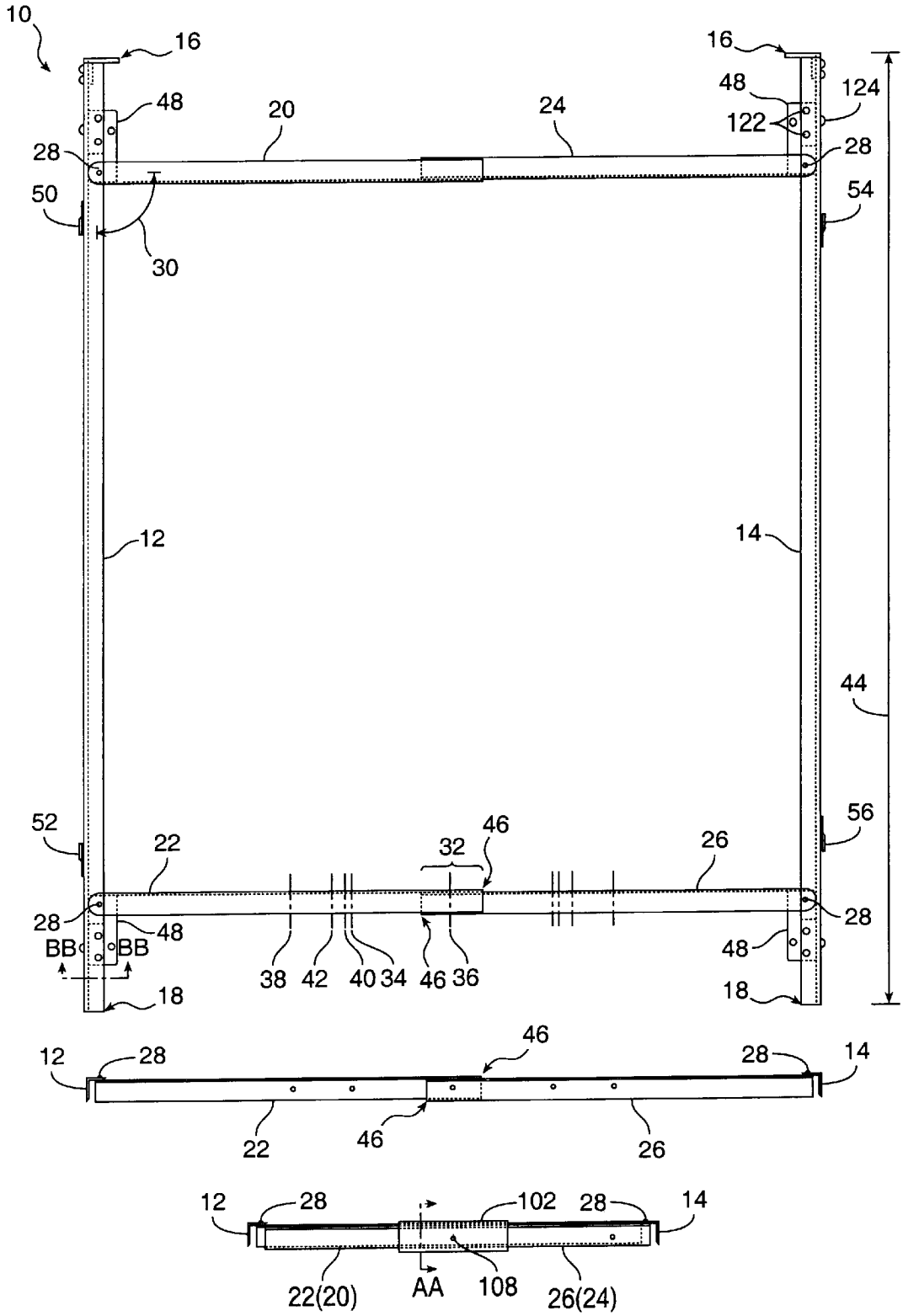
FIG. 1A illustrates top and rear views of an assembled bed frame using a single pair of frame assembly pieces according to a presently preferred embodiment of the present invention.

Top and rear views of the bed frame is shown in FIG. 1A, in which the bed frame assembly 10 is illustrated. The bed frame assembly 10 consists of a left side-rail 12 and a right side-rail 14. Both side-rails 12 and 14 have a head end 16 and a foot end 18. A left head cross-bar 20 is disposed on the left side-rail 12 near its head end; a left foot cross-bar 22 is disposed on the left side-rail 12 near its foot end. Similarly a right head cross-bar 24 and a right foot cross-bar 26 are disposed on right side-rail 14. The cross-bars 20, 22, 24 and 26 are all connected to their respective side-rails 12 and 14 by means of a rivet or alternate type of pin-joint 28, enabling the cross-bar to pivot across two perpendicular positions by angle 30 for either convenient storage or utilitarian assembly.

The bed frame assembly 10 as configured for use, disposes between head pair cross-bars 20 and 24 and between foot pair cross-bars 22 and 26 an overlap 32 for each pair. At the center of the overlap should be an opening to accommodate a locking mechanism to hold the cross-bars in position. The opening locations depend on the amount of overlap required, which in turn depends on the ultimate width of the box-spring that one or a pair bed frame assembly 10 must accommodate. The narrowest commonly available box-spring on the market is the twin, and the opening location associated with this bed frame width is marked by a "T" for position 34. The next size is the full, with the opening location marked by a "F" for position 36. Both the twin and full size positions 34 and 36 can be accommodated by a single bed frame assembly 10.

For sizes wider than full, a pair of bed frame assemblies 10 is required, held side-by-side. The queen has an opening marked by a "Q" for position 38, which would be set for both bed frame assemblies 10. The king is the widest of current market sizes and is marked by a "K" for position 40. The cal-king (more popular on the West Coast) is slightly narrower and longer than the king, marked by a "CK" for position 42. The present invention is capable of accommodating all these sizes without the additional use of a separate center-rail for mid-span support or extension cross-bars to connect the center-rail to the remainder of the bed frame assembly. In addition, the present invention uses a length 44 for the side-rails that will accommodate all of the box-spring sizes from twin to cal-king without unsupported overhang causing the box-spring to be upended at the foot end, or excessive length over which a person may trip in the dark.

The opening for the full position 36 is disposed near the end of the cross-bar 22. Because a pair of bed frames is used for the larger box-spring sizes and because these current sizes are less than twice the width of the full size, the connection between the cross-bars results in a much greater overlap 32 for a paired bed frame than for a single bed frame. Hence, the openings are disposed for positions queen 38, king 40 and cal-king 42 more inward from the cross-bar end 46 and closer to the pin-joint 28 connecting the cross-bar to the side-rail. These openings are disposed on each cross-bar 20, 22, 24 and 26 to permit a pin to be inserted within the overlap 32.

A bed-leg may be attached at the pad 48 towards the head and foot ends of the side-rails 12 and 14. The vertical inhibitors to prevent box-spring from sliding from side-to-side or to interlock a pair of bed frame assemblies 10 together are represented by flanges—left head flange 50, left foot flange 52, right head flange 54 and right foot flange 56. The head flanges 50 and 54 are identical to each other; the foot flanges 52 and 56 are identical to each other, and the head and foot flanges are mirror-symmetrical to each other for reasons discussed below.

Figure 1B:
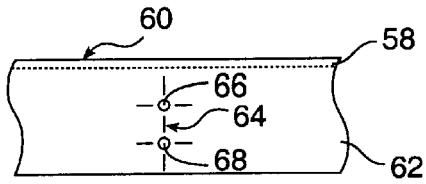
FIG. 1B is a side view of a side-rail according to a presently preferred embodiment of the present invention.
Figure 1C:
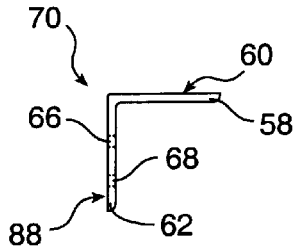
FIG. 1C is a cross-section view of a side-rail according to a presently preferred embodiment of the present invention.

A side view of a side-rail is illustrated in FIG. 1B. The horizontal member 58 of the side-rail has a top surface 60 on which the box-spring is supported. The vertical member 62 is disposed downward from horizontal member 58, rather than upward as in the conventional configuration. Two openings are vertically disposed 64 on the vertical member 62. The top opening 66 holds a rivet or pin joint for a flange, while the bottom opening 68 constitutes a threaded hole through which a bolt or other threaded fastener is passed to secure a flange in position by friction. A front view of a side-rail is illustrated in FIG. 1C. The inverted L-shaped cross-section 70 is clearly displayed with the horizontal member 58 and the vertical member 62 shown in profile.

Figure 1D:
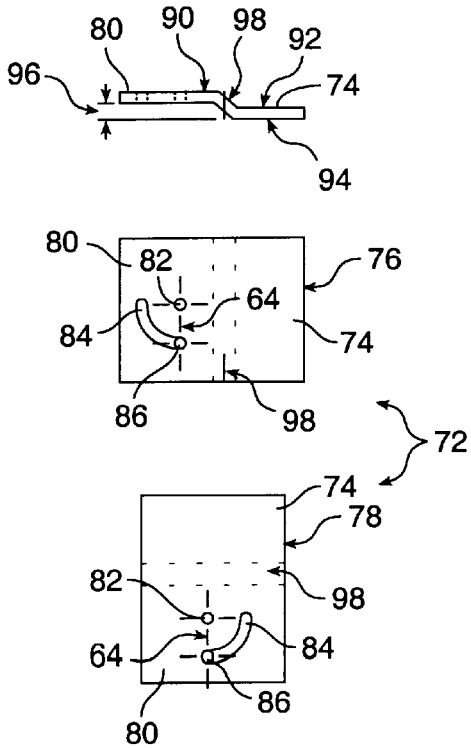
FIG. 1D illustrates a top and two side views of a flange according to a presently preferred embodiment of the present invention.

Side and top views of a flange can be seen in FIG. 1D. A head flange 72 is shown which is the same as the top view in FIG. 1A for head flanges 50 and 54. (The geometry of head flange 72 is a mirror reflection of foot flanges 52 and 56.) The head flange 72 contains a tang 74 that may be oriented in a horizontal position 76 or a vertical position 78, and a tongue 80 that is pivotally secured to a side-rail by a rivet passing through a rivet opening 82. The tongue 80 also has a groove 84 (a partial circular slot) disposed at a radius equal to the distance between the openings 66 and 68 on the vertical member 62 of a side-rail as shown in FIG. 1B. The groove encompasses a 90°-arc to enable rotation of the head flange 72 about the rivet opening 82 in order to enable a bolt to pass between an opening location 86 which is vertically disposed 64 from rivet opening 82. The bolt passing through location 86 on the tongue 80 and opening 68 on vertical member 62 of the side-rail enables the head flange 72 to be detachably secured for the tang 74 to be in either the horizontal position 76 or the vertical position 78. In the vertical position 78, the tang 74 serves to obstruct the box-spring from sliding sideways off the bed frame in a box-spring restraint position. In the horizontal position 76, the tang 74 permits a pair of side-rails from two separate bed frame assembly pairs to detachably fastened to each other as a center-rail interlock position in order to form a width-expanded bed frame for accommodating the wider class of box-springs. The orientation of the head flange 72 may be thus altered from the tang 74 in the horizontal position 76 to the vertical position 78 by rotating the tongue 80 counter-clockwise by 90° on the rivet axis through the rivet opening 82, and vice-versa rotating the tongue 80 clockwise 90° on the rivet axis for the reverse from vertical position 78 to horizontal position 76. The foot flange operates similarly but in clockwise direction for changing from horizontal position 76 to vertical position 78.

A vertical member 66 of a side-rail has an outer surface 88 in FIG. 1C. The tongue 80 has an attach-surface 90 that faces outer surface 88. The tang 74 has an inner surface 92 that may face such a surface from another tang 74 on a separate interconnecting head flange 72. The tang 74 also has outer surface 94. To permit the tangs 74 from two distinct head flanges 72 to interconnect with each other when in the horizontal position while the tongue 80 is attached to a vertical member 66 of a side-rail, an offset 96 may be provided, so that tang inner surface 92 and tongue attach-surface 90 may be substantially parallel to each other, but not be in the same plane. This offset 96 may be provided by a bend 98 separating the planes between tang 74 and tongue 80. The offset 96 must be sufficiently large to permit a gap between tang inner surface 92 and vertical member surface 66 that enables another tang 74 to slide between these surfaces and yet inhibit movement that would cause the a pair of assembled bed frames from detaching involuntarily.

Figure 1E:
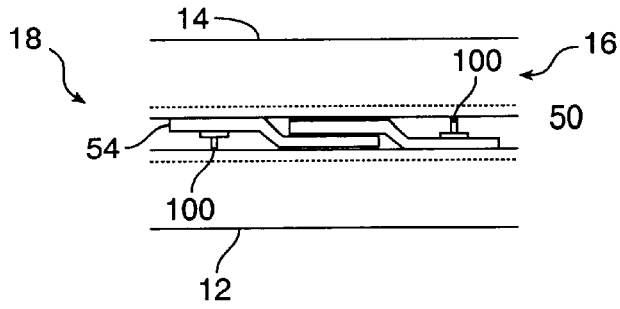
FIG. 1E is a top view of a pair of flanges disposed on a pair of side-rails so as to interlock as a center-rail according to a presently preferred embodiment of the present invention.

The manner in which side-rails may be secured to form a center-rail in an attached pair of bed frame assemblies 10 is shown in FIG. 1E as a top view for the head end 16 (from FIG. 1A). Left head flange 50 is attached to left side-rail 12 (of a bed frame assembly on the right), and right head flange 54 is attached to right side-rail 14 (of a bed frame assembly on the left). Each flange 50 and 54 is attached to its respective side-rail 12 and 14 by a rivet 100 (passing through opening 66 in FIG. 1B and opening 82 in FIG. 1D) as well as a bolt vertically disposed under the rivet (the bolt passing through opening 68 on FIG. 1B and groove 84 on FIG. 1D). The tang 74 of each flange 50 and 54 may be slidably inserted from a vertical direction. A horizontal sliding direction in which right side-rail 14 may move towards the head end 16 is precluded because the flanges at the foot 18 of the bed frame are designed and disposed in a manner to permit right side-rail 14 to move towards the foot end 18, and vice versa for the left side-rail 12. In this fashion, the left side-rail 12 and the right side-rail 14 may serve together as a pair of center-rails without the use of separate inventory items in order to provide structural support in the center of the bed frame.

In the preferred embodiment, a head flange 72, as well as the foot flange mirror reflection counterpart, would be formed from a single metal plate. This plate might then be stamped so as to include the bend 98 creating an offset 96 between the tongue attach surface 90 and the tang inner surface 92, the rivet opening 82 and the groove 84 to permit a bolt to pass through. The form of head flange 72 would include the design depicted in FIG. 1D as well as a mirror reflection thereof for the foot flange. In the preferred embodiment, flanges would be permanently attached to the side-rail by rivets permitting pivot rotation about the rivet axis, so that a flange is not normally separated from the side-rail. The flange may thus be pivoted in one of two positions oriented 90° from one another: the box-spring restraint position and the center-rail interlock position.

Figure 1F:
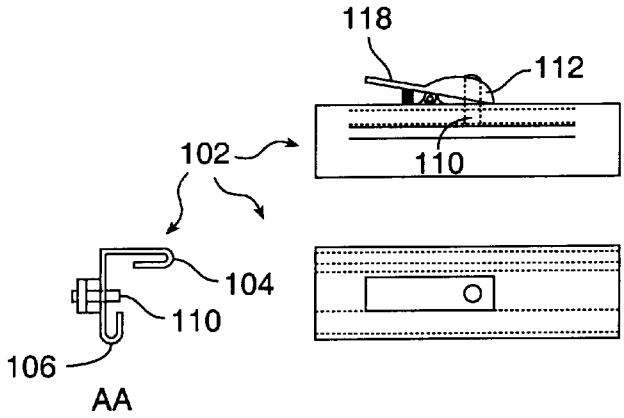
FIG. 1F illustrates plan, top and side views of a sleeve, and a side view of a sleeve disposed on a cross-bar pair according to a presently preferred embodiment of the present invention.

A pair of cross-bars such as foot left cross-bar 22 and foot right cross-bar 26 are connected together by a sleeve 102 shown in top, side and plan views in FIG. 1F. The sleeve 102 may be composed of a sheet metal bent to form an upper hook 104 to hold the horizontal members of the overlapping cross-bars, and a lower hook 106 to hold the vertical members of the horizontal cross-bars from rotating in the roll or yaw axes (parallel to the side-rails 12 and 14 for roll or parallel to the cross-bar pin-joints 28 for yaw). The overlapping cross-bars 22 and 26 are aligned so that a common opening 108 corresponding to a set box-spring size position 34, 36, 38, 40, or 42 may be formed. A slidably retractable pin 110 may be inserted through openings 108 in the sleeve 102, left cross-bar 22 (or 20) and right cross-bar 26 (or 24). The pin 110 may be attached to a clamp 112 that pivots on a roller fulcrum 114. The pin 110 remains inserted into the sleeve 102 by a spring 116 which maintains tension on the clamp 112 thereby pushing the pin 110 into and through the opening 106. A tab 118 attached to or part of the clamp 112 is disposed away from the fulcrum 114 and the spring 116. When force is applied against the tab 118 in the direction towards the sleeve 102, the spring 116 is compressed, rotating the clamp counterclockwise (in the FIG. 1F top view), lifting the pin 110 out of opening 106, thus permitting release of the overlapping cross-bars for repositioning or disassembly. This cross-bar attachment design facilitates rapid assembly and disassembly using a quick-release device to a default locking mechanism. In one of the preferred embodiments, the slidably retractable pin 110 may be slightly curved to facilitate pin insertion into symmetrical openings 106 with the smallest freeplay (that is, minimum opening oversize).

Figure 1G:
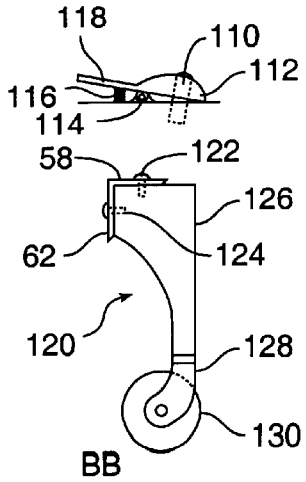
FIG. 1G is a front view of a leg with a castor according to a presently preferred embodiment of the present invention.

In order to support a bed frame assembly 10 above the floor, a plurality of bed-legs are required near the side-rails. FIG. 1G illustrates a side-view of a bed-leg 120. In addition, to prevent cross-bars from sagging downward for the side-by-side bed frame assemblies, at least one bed-leg 120 may be desirable near a side-rail serving as a center-rail. The cross-bar overlap 32 for the queen size position 38 inhibits disposing a bed-leg on the cross-bar as is conventionally done. For the present invention, therefore, the bed-legs 120 are permanently attached to the side-rails on pads 48. An additional advantage to this arrangement is that the bed-legs 120 remain in position while the cross-bars are rotated during assembly or disassembly, as compared to the conventional designs. The bed-leg 120 is attached along the horizontal member 58 at the tab 48 (on left side-rail 12 for example) with fasteners such as rivets at pad 122, and on vertical side of a side-rail 62 with fasteners at position 124. The bed-leg 120 is composed of a top member 126 which is disposed inward to the bed frame (towards the cross-bar end 46 when the cross-bar is positioned perpendicular to the side-rail), a shaft 128 permitting rotation along the vertical axis of the bed-leg, and a castor 130 which may rotate about an axis perpendicular to the vertical bed-leg axis. Alternatively, a bed-leg 120 may incorporate a pad rather than a shaft and castor.

Figure 2A:
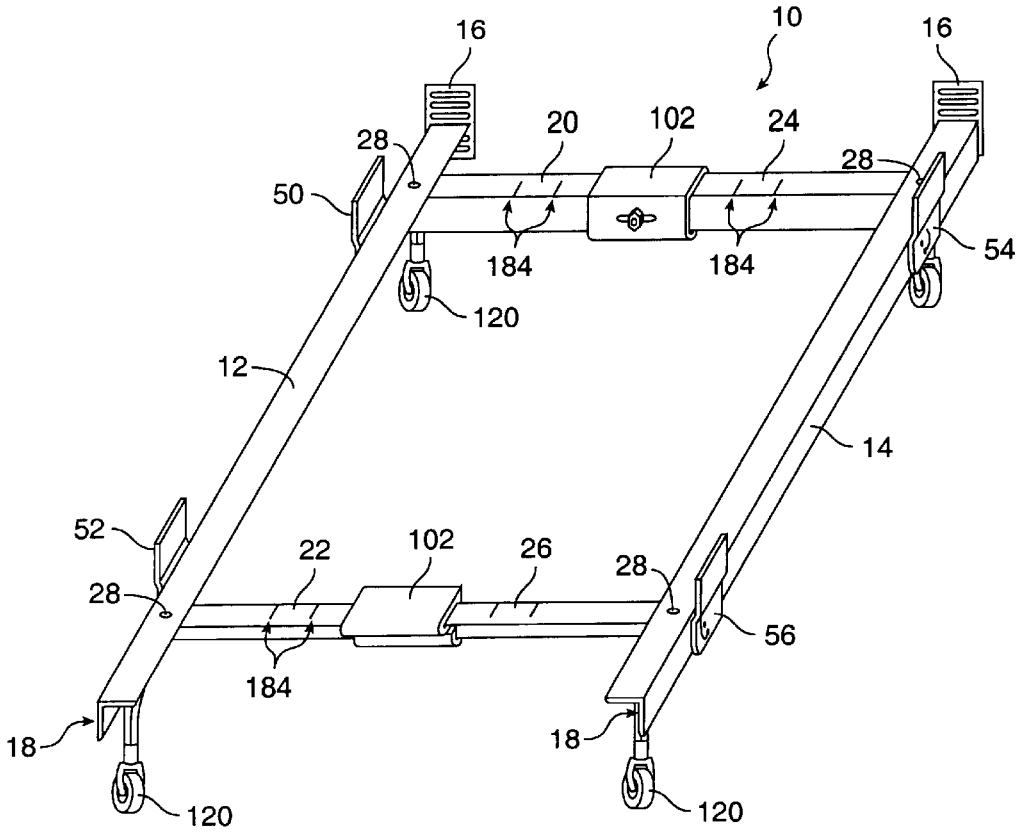
FIG. 2A is an isometric view of an assembled bed frame using a single pair of frame assembly pieces according to one of a presently preferred embodiment of the present invention.

An isometric view of the bed frame assembly 10 with a single pair of side-rails can be seen in FIG. 2A to better illustrate the novel features of the invention. A left side-rail 12 and a right side-rail 14 are disposed parallel to one another, each having a head end 16 and a foot end 18 and bed-legs 120 to elevate the side-rails 12 and 14 from the floor. Left side-rail 12 has a head cross-bar 20 and a foot cross-bar 22, and right side-rail 14 also has a head cross-bar 24 and a foot cross-bar 26. Each cross-bar is attached to its respective side-rail by a pin-joint 28. The head cross-bars 20 and 24 overlap each other and are held together by a sleeve 102 which envelopes both cross-bars. The foot cross-bars 22 and 26 are similarly held by a sleeve 102.

The bed frame assembly 10 has four flanges 50, 52, 54 and 56, each with the tang (see item 74 on FIG. 1D) pointing upward, as presently preferred in the present invention when assembled to accommodate a twin-size or full-size box-spring and mattress. The left side-rail 12 has a head flange 50, and a foot flange 52, which is a mirror reflection of the head flange. The right side-rail 25 has a head flange 54 (identical to head flange 50) and a foot flange 56 (identical to foot flange 52).

Figure 2C:
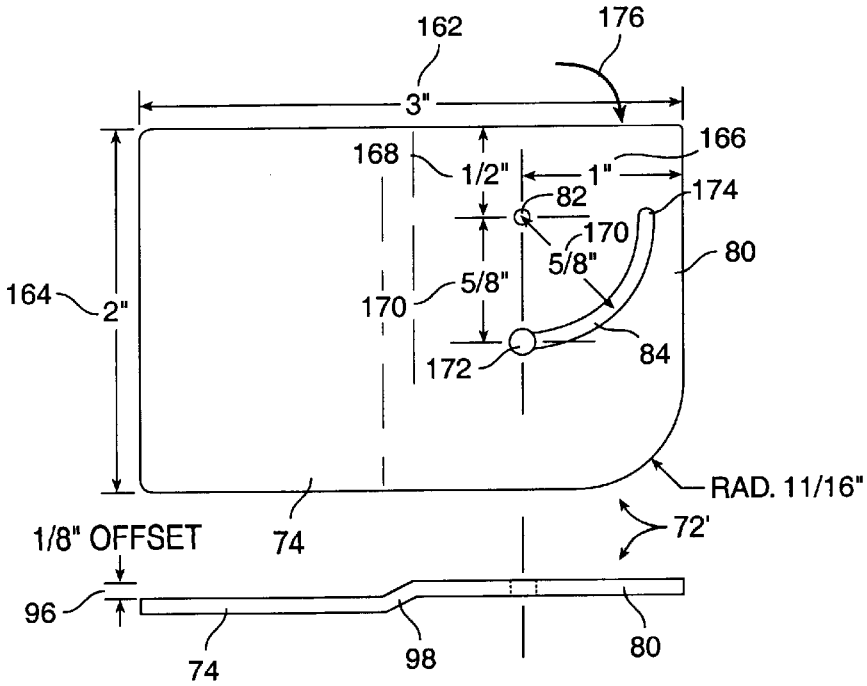
FIG. 2C illustrates side and top views of a flange with dimensions specified thereon according to a presently preferred embodiment of the present invention.
Figure 2B:
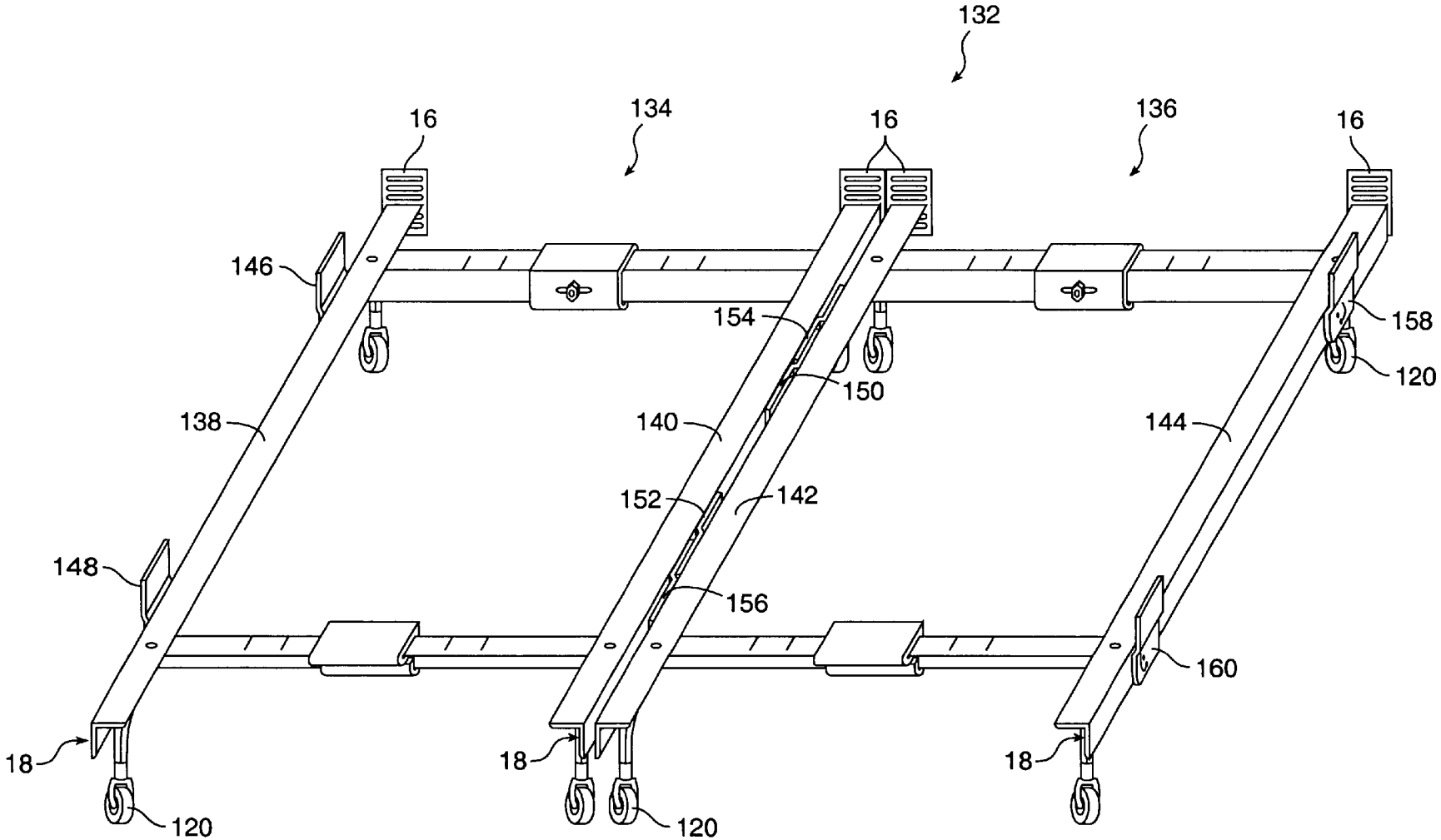
FIG. 2B is an isometric view of an assembled bed frame using two pairs of frame assembly pieces linked together according to a presently preferred embodiment of the present invention.

FIG. 2B illustrates an isometric view of the dual bed frame assembly 132 with two pairs of side-rails to better display the novel features of the invention. A left bed frame 134 is disposed side-by-side with a right bed frame 136. Each bed frame is identical to the single pair bed frame assembly 10 as shown in FIG. 2A except for the orientation of the flanges (discussed in more detail below). The dual bed frame assembly 132 has a head end 16 and a foot end 18, and supported above the floor on bed-legs 120. The left bed frame 134 has a left side-rail 138 and a left center-rail 140; the right bed frame 136 has a right center-rail 142 and a right side-rail 144. Upon separation of left bed frame 134 and right bed frame 136 into two separate bed frames, the left center-rail 138 becomes a right side-rail, and the right center-rail 140 becomes a left side-rail. By using two side-rails as a connected pair of center-rails, the present invention provides for twice the support available from a single center-rail from the prior art.

The dual bed frame assembly 132 has eight flanges 146, 148, 150, 152, 154, 156, 158 and 160, as presently preferred in the present invention when assembled to accommodate a queen-size, king-size or cal-king-size box-spring and mattress. The left side-rail 138 has a head flange 146, and a foot flange 148. The left center-rail 140 has a head flange 150 and a foot flange 152. The right center-rail 142 has a head flange 154 and a foot flange 156. The right side-rail 144 has a head flange 158 and a foot flange 160. The head flanges 146, 150, 154 and 158 are identical in shape to each other. The foot flanges 148, 152, 156 and 160 are identical in shape to each other and are mirror symmetrical to the head flanges 146, 150, 154 and 158. On the left side-rail 138 and the right side-rail 144, the flanges 146, 148, 158 and 160 are oriented so that the tang (see item 74 on FIG. 1D) projects upward to inhibit the box-spring from moving sideways. The head flange 150 on the left center-rail 140 and foot flange 156 on the right center-rail 142 are oriented towards the head end 16. The foot flange 152 on the left center-rail 140 and the head flange 154 on the right center-rail 142 are oriented towards the foot end 18. The tang on head flange 150 fits between the tang on head flange 154 on its left side and the right center-rail 142 on its right side. Complimentarily, the tang on head flange 154 fits between left center-rail 140 the tang on head flange 150 on its right side. (See also FIG. 1E.) Similarly, the tang on foot flange 152 fits between the tang on foot flange 156 on its left side and the right center-rail 142 on its right side; and the tang on foot flange 152 fits between the left center-rail 140 on its left side and the tang on foot flange 156 on its right side. The tangs on the head flanges 150 and 154 and on the foot flanges 152 and 156 slide vertically until the tangs oppose each other in the manner described and shown.

In the most preferred embodiment of the invention, the foot flange 72' may have detailed dimensions as shown in FIG. 2C in side view and top view. The foot flange 72' has a tang 74 and a tongue 80 connected at a bend 98 (as also seen in FIG. 1D), the tang 74 and tongue 80 being parallel to one another. Its dimensions are a length 162 of 3.0 inches, a width 164 of 2.0 inches, an offset 96 of 0.125 inch between tang 74 and tongue 80. It is preferably composed of metal plate that may be stamped into the shape as shown.

An opening 82 through which a rivet may pass through to pivotally secure the foot flange 72' to a side-rail is disposed at a length distance 166 of 1.0 inch and a width distance 168 of 0.5 inch from the edges of the tongue 80. The tongue 80 also has a groove 82 through which a bolt may pass through the foot flange 72' at a radial distance 170 of 0.625 inch below the rivet centerline of opening 82. This bolt position 172 marks the left end of the groove 82 and corresponds to an orientation in which the foot flange 72' may interpose with a flange from a companion bed frame. The groove 82 has a right end 174. When the foot flange 72' is rotated −90° as shown in rotation direction 176, the tang 74 will be oriented vertically in order to serve to inhibit lateral movement of a box-spring. The head flange 72 shown in FIG. 1E may have identical dimensions to foot flange 72' described in detail in FIG. 2C, but in mirror reflection and pivoted accordingly.

The flange may also incorporate fillets 178 to eliminate sharp edges for consumer safety reasons, as well as a rounded edge 180 at a radius 182 of 0.6875 inch in order to enable the consumer to more easily identify the axis of rotation.

In an alternative embodiment of the present invention, the rivet opening 82 and groove 84 may be replaced by at least two openings aligned with complimentary threaded openings on the side-rail through which a one bolt through each opening could be inserted. Such a flange may then be bolted to a side-rail in one of two positions oriented 180° from one another: the box-spring restraint position and the center-rail interlock position. The tongue 80 may have a width 164 sufficient to extend above the horizontal plane on which the box-spring is disposed when the flange is disposed in box-spring restraint position.

Yet another alternative embodiment of the present invention may be replacing two cross-bars attached to each side-rail mounted to two corresponding cross-bars on a parallel side-rail so that the cross-bars are perpendicular to their attached side-rails, with one or two cross-bars on each side-rail mounted to one or two corresponding cross-bars on a parallel side-rail so that the cross-bars are parallel to each other, but each cross-bar forms an acute angle with its attached side-rail.

A further preferred embodiment incorporates scribes 184 or other marks on the cross-bars 20, 22, 24, and 26 as shown in FIG. 2A to facilitate alignment of the openings 108 through which the slidably retractable pin 110 (see FIG. 1F) must pass through in order to secure the bed frame assembly 10.

While embodiments and applications of the invention have been shown and described, it would be apparent to those of ordinary skill in the art, after a perusal of the within disclosure, that many more modifications than mentioned above are possible without departing from the inventive concepts herein. The invention, therefore, is not to be restricted except in the spirit of the appended claims.

What is claimed is:

1. A bed frame comprising:

at least one pair of frame assembly pieces, each piece having a side-rail with a horizontal surface and a vertical surface, a head end and a foot end, and at least one cross-bar attached to said side-rail, said horizontal surfaces defining a plane on which a box-spring may be disposed;

a coupler securing a first cross-bar to a second cross-bar, said first cross-bar connected to a first side-rail and said second cross-bar connected to a second side-rail; and at least one pair of flanges disposed on each said side-rail, each said flange assuming one of a first position and a second position, said first position juxtaposing said flange between said side rail and a complimentary flange of another bed frame so as to couple the bed frame and said another bed frame together, said second position causing a portion of said flange to extend above said plane.

2. A bed frame according to claim 1, wherein said side-rail and said at least two cross-bars have an inverted L-shaped cross-section, said inverted L-shaped cross-section having a horizontal member and a vertical member, said vertical member being disposed below said horizontal member when said bed frame is in an upright position.

3. A bed frame according to claim 1, further comprising:

at least one opening in said side-rail for pivotally attaching said flange to said side-rail;

said flange including a tongue with an interface surface wherein said interface surface is substantially parallel to a surface on said side-rail; and a tang extending from said tongue in a direction substantially parallel to said interface surface and offset from said interface surface by a distance sufficient to permit a flat piece having the same thickness as said tang to be slidably positioned between said tang and a vertical plane substantially parallel to said interface surface, said interface surface facing a vertical member of said side-rail, wherein said flange may be disposed in one of at least two positions.

4. A bed frame according to claim 3 wherein said tongue and said tang are composed of a single piece of stamped metal plate.

5. A bed frame according to claim 3 wherein said at least one opening on said flange comprises a rivet aperture and a portion of a circular slot permitting 90° rotation about an axis parallel to said rivet aperture.

6. A bed frame according to claim 3 further comprising a mechanism to pivotally attach said at least one pair of flanges to a first side-rail said mechanism comprising:

a pivotal attachment device passing through openings in said first side-rail and said tongue of said at least one pair of flanges; and a threaded fastener passing through at least one aperture of said tongue of said at least one pair of flanges and through said first side-rail.

7. A bed frame according to claim 6 wherein said pivotal attachment device further comprises a rivet.

8. A bed frame according to claim 1 wherein said coupler securing a first cross-bar to a second cross-bar is a sleeve.

9. A bed frame according to claim 8 wherein said sleeve further includes a retractable pin to secure said sleeve to said first cross-bar and to said second cross-bar.

10. A bed frame according to claim 1 wherein the length of said side-rail corresponds to the length of a cal-king-size bed frame.

11. A bed frame according to claim 1 further including at least one opening in said first cross-bar and said second cross-bar for engaging a pin, said opening disposed at a fixed distance from said side-rail.

12. A bed frame according to claim 11 wherein said fixed distance corresponds to either half the width of a standard bedsize from the group consisting of twin and full, or slightly less than a quarter the width of a standard bedsize from the group consisting of queen, cal-king and king.

13. A bed frame according to claim 1 further comprising marks on said first cross-bar and said second cross-bar to identify a position at which said first cross-bar and second cross-bar overlap.

14. A bed frame according to claim 8 wherein said sleeve further comprises:

a slidable member having a first hook to secure said first cross-bar to said second cross-bar in a first plane, a second hook to secure said first cross-bar to said second cross-bar in a second plane, and an opening; and a pin insertable in said opening in order to restrict movement of either said first cross-bar or said second cross-bar along a longitudinal direction of said first cross-bar.

15. A bed frame according to claim 14 wherein said pin is attached to a clamp which pivots between a spring-release position and a spring-retract position.

16. A bed frame according to claim 1 further comprising at least one leg attached to each said side-rail.

17. A bed frame comprising:

at least one pair of frame assembly pieces, each piece of a first piece and a second piece having a side-rail with a horizontal surface and a vertical surface, a head end and a foot end, and a first cross-bar disposed at a first fixed distance from said head end and a second cross-bar disposed at a second fixed distance from said foot end, said horizontal surfaces defining a plane on which a box-spring may be disposed;

a sleeve for securing said first cross-bar of said first piece disposed substantially parallel to and overlapping said first cross-bar of said second piece;

at least one complimentary pair of flanges disposed on each said side-rail, each said flange assuming one of a first position and a second position, said first position juxtaposing said flange between said side rail and a complimentary flange of another bed frame so as to couple the bed frame and said another bed frame together, said second position causing a portion of said flange to extend above said plane wherein each flange of said pair has a tongue with an interface surface, a tang extending substantially parallel from said tongue along a first direction at an offset from said interface surface, said offset being at least slightly larger than the thickness of said tang; and each of said flanges pivotally mounted to a side-rail wherein said tang may be slidably disposed between said side-rail and another tang in an interlock position or vertically perpendicular to said side-rail in a box-spring restriction position, enabling said side-rail with said tang in said interlock position to be attached to another side-rail with a second pair of flanges.

18. A bed frame according to claim 17 further comprising at least one leg attached to each said side-rail.

19. A bed frame comprising:

at least one pair of frame assembly pieces, each piece of a first piece and a second piece having a side-rail, said side-rail having a horizontal surface and a vertical surface, a head end and a foot end, and a first cross-bar disposed at a first fixed distance from said head end and a second cross-bar at a second fixed distance from said foot end, and at least one pair of legs disposed at a third fixed distance from said head end and a fourth fixed distance from said foot end, said horizontal surfaces defining a plane on which a box-spring may be disposed;

a first sleeve for securing said first cross-bar of said first piece disposed substantially parallel to and overlapping said first cross-bar of said second piece;

a second sleeve for securing said second cross-bar of said first piece disposed substantially parallel to and overlapping said second cross-bar of said second piece;

at least one complimentary pair of flanges disposed on each said side-rail, each said flange assuming one of a first position and a second position, said first position juxtaposing said flange between said side rail and a complimentary flange of another bed frame so as to couple the bed frame and said another bed frame together, said second position causing a portion of said flange to extend above said plane, wherein each flange of said pair has a tongue with an interface surface, a tang extending substantially parallel from said tongue along a first direction at an offset from said interface surface, said offset being at least slightly larger than the thickness of said tang; and each of said flanges pivotally mounted to said side-rail wherein said tang may be slidably disposed between said side-rail and another tang in an interlock position or vertically perpendicular to said side-rail in a box-spring restriction position enabling said side-rail with said tang in said interlock position to be attached to another side-rail with a second pair of flanges, said interlock position inhibiting separation of said first pair of flanges from said second pair of flanges in a horizontal direction.

20. A bed frame according to claim 19 wherein said pair of legs further comprises:

a top member rigidly mounted to bottom of said side-rail;

a post inserted within said top member wherein the centerline of said post is offset from a centroid of said top member by a distance no greater than the distance from said centroid to an edge of said top member in a direction towards said cross-bar when said bed frame is assembled; and a rotating castor with an axis of rotation offset from the centerline of said post at a distance and in a direction between the centerline of said post and said centroid of said top member.

21. A bed frame comprising:

at least one pair of frame assembly pieces, each piece of a first piece and a second piece having a side-rail said side-rail having a horizontal surface and a vertical surface, a head end and a foot end, and a first cross-bar pivotally disposed on a first pin-joint at a first fixed distance from said head end and a second cross-bar pivotally disposed on a second pin-joint at a second fixed distance from said foot end, and at least one pair of legs, wherein said side-rail and said first cross-bar and said second cross-bar have an inverted L-shaped cross-section, said inverted L-shaped cross-section having a horizontal member and a vertical member, said vertical member being disposed below said horizontal member when said at least one pair of frame assembly pieces is in an upright position, wherein said horizontal surfaces defining a plane on which a box-spring may be disposed, wherein said first cross-bar includes at least one opening for engaging a pin, said opening disposed at a third fixed distance from said first pin-joint and said second cross-bar includes at least one opening for engaging a pin, said opening disposed at a fourth fixed distance from said second pin-joint, said third fixed distance and fourth fixed distance corresponding to either half the width of a standard bedsize from the group consisting of twin and full, or slightly less than a quarter the width of a standard bedsize from the group consisting of queen, cal-king and king, and wherein said at least one pair of legs is disposed at a fifth fixed distance from said head end and a sixth fixed distance from said foot end, each leg of said at least one pair of legs having a top member rigidly mounted to bottom of said side-rail, a post inserted within said top member, and a rotating castor;

a sleeve for securing said first cross-bar of said first piece disposed parallel to and overlapping said first cross-bar of said second piece further comprising a slidable member having a first hook to secure said first cross-bar of said first piece to said first cross-bar of said second piece in a first plane, a second hook to secure said second cross-bar of said first piece to said second cross-bar of said second piece in a second plane, and an opening for receiving a pin to restrict movement of either said first cross-bar or said second cross-bar from either said first piece of said second piece along a longitudinal direction of said first cross-bar, wherein said pin is attachable to a clamp which pivots between a spring-release position and a spring-retract position;

at least one complimentary pair of flanges disposed on each said side-rail, each said flange assuming one of a first position and a second position, said first position juxtaposing said flange between said side rail and a complimentary flange of another bed frame so as to couple the bed frame and said another bed frame together, said second position causing a portion of said flange to extend above said plane, wherein each flange of said at least one complimentary pair has a tongue with an interface surface, a tang extending substantially parallel from said tongue by a seventh fixed distance sufficient to permit a flat piece having the same thickness as said tang to be slidably positioned between said tang and a plane substantially parallel to said interface surface, a tongue with an interface surface wherein said interface surface, and at least one opening for pivotally attaching said flange on said interface surface to said vertical member on said side-rail; and each of said flanges pivotally mounted to said side-rail wherein said tang may be slidably disposed on said side-rail in an interlock position or vertically perpendicular to said side-rail in a box-spring restriction position enabling said side-rail with said tang in said interlock position to be attached to another side-rail with a second pair of flanges, said tang on at least one pair of flanges and second pair of flanges disposed between said side-rail and said another side-rail inhibiting separation of said first pair of flanges from said second pair of flanges in a horizontal direction.

22. A method for assembling a bed frame having a pair of side-rails, each said side-rail having at least one cross-bar and at least one pivotally mounted flange, said method comprising:

standing the pair of side-rails upright wherein the pair of side-rails form a horizontal plane on a top member of each of a left side-rail and a right side-rail;

aligning said left side-rail to be approximately parallel to said right side-rail;

securing a complimentary pair of cross-bars wherein said complimentary pair of cross-bars comprises at least one left cross-bar on said left side-rail and is parallel with at least one right cross-bar on right side-rail;

disposing at least one flange on a side member of said left side-rail wherein said at least one flange extends above the horizontal plane; and disposing at least one flange on a side member of said right side-rail wherein said at least one flange extends above the horizontal plane.

23. A method to assemble a bed frame having two pairs of side-rails comprising:

standing said two pairs of side-rails upright wherein said two pairs of side-rails form a horizontal plane on a top member of each of a left side-rail, a left center-rail, a right center-rail and a right side-rail;

aligning said left side-rail to be approximately parallel to said left center-rail;

aligning said left center-rail to be approximately parallel to said right center-rail;

aligning said right center-rail to be approximately parallel to said right side-rail;

securing a complimentary pair of left cross-bars wherein said complimentary pair of left cross-bars comprises at least one left cross-bar on said left side-rail and is parallel with at least one right cross-bar on left center-rail;

securing a complimentary pair of right cross-bars wherein said complimentary pair of right cross-bars comprises at least one left cross-bar on said right center-rail and is parallel with at least one right cross-bar on right side-rail;

disposing at least one flange on a side member of said left side-rail wherein said at least one flange extends above the horizontal plane;

disposing at least one flange on a side member of said left center-rail and another at least one flange on a side member of said right center-rail wherein said at least one flange couples with said another at least one flange; and disposing at least one flange on a side member of said right side-rail wherein said at least one flange extends above the horizontal plane.

* * * * *